US006488540B2

(12) United States Patent
Coyle, Jr. et al.

(10) Patent No.: US 6,488,540 B2
(45) Date of Patent: Dec. 3, 2002

(54) MULTI-RECEPTACLE ELECTRICAL OUTLET

(75) Inventors: William J. Coyle, Jr., Toms River, NJ (US); Harold Minkwitz, Fairlawn, NJ (US)

(73) Assignee: Heyco, Inc., Toms River, NJ (US)

( * ) Notice: Subject to any disclaimer, the term of this patent is extended or adjusted under 35 U.S.C. 154(b) by 0 days.

(21) Appl. No.: 09/947,865

(22) Filed: Sep. 6, 2001

(65) Prior Publication Data

US 2002/0031951 A1 Mar. 14, 2002

Related U.S. Application Data

(60) Provisional application No. 60/231,021, filed on Sep. 8, 2000.

(51) Int. Cl.[7] ..... H01R 25/00
(52) U.S. Cl. ..... 439/650
(58) Field of Search ..... 439/107, 214, 439/604, 606, 650, 651, 652, 653, 654

(56) References Cited

U.S. PATENT DOCUMENTS 4,717,350 A 1/1988 Lax
4,979,907 A 12/1990 Lee
5,232,381 A * 8/1993 Yu ..... 439/652
5,272,587 A * 12/1993 Wan ..... 361/111
5,281,172 A * 1/1994 Luu ..... 439/651
5,383,799 A * 1/1995 Fladung ..... 439/652
5,425,659 A * 6/1995 Banks ..... 439/650
5,443,400 A 8/1995 Brown et al.
5,486,121 A * 1/1996 Miller ..... 439/652
5,526,225 A * 6/1996 Wang ..... 361/643
5,582,520 A 12/1996 Doudon
5,603,638 A 2/1997 Brown et al.
5,647,751 A 7/1997 Shulman et al.
5,816,860 A 10/1998 Blanche
5,888,105 A 3/1999 Brown et al.
5,971,808 A * 10/1999 Chiang et al. ..... 439/654
6,054,657 A * 4/2000 Liao ..... 200/51.02

* cited by examiner

*Primary Examiner*—Brian Sircus
*Assistant Examiner*—Thanh-Tam Le
(74) *Attorney, Agent, or Firm*—Selitto, Behr & Kim

(57) ABSTRACT

A premold for a powercord includes a housing which is provided with a network of walls and partitions that form channels and cavities adapted to securely receive a plurality of busbar stampings, each having multiple female contacts. Each busbar stamping has a crossbar, a plurality of female contacts and a wire crimp extension which extends outwardly from a rear wall of the housing for connection by crimping to a corresponding wire of a power supply cable. A front wall of the housing includes a plurality of outlet sites, each of which is adapted to receive a male electrical plug.

10 Claims, 8 Drawing Sheets

MULTI-RECEPTACLE ELECTRICAL OUTLET

CROSS REFERENCE TO RELATED APPLICATION

This is a §111(a) application relating to U.S. application Ser. No. 60/231,021 filed Sep. 8, 2000.

Field of the Invention

The present invention relates to electrical outlets, and more particularly to multi-receptacle female outlets.

BACKGROUND OF THE INVENTION

Various types of electrical outlets have been proposed in the past. Brown et al. U.S. Pat. No. 5,603,638 and Shulman et al. U.S. Pat. No. 5,647,751, which are owned by the assignee of the present application, each disclose the broad concept of a pre-mold for a powercord that has a single female electrical outlet site. The Brown et al. '638 patent discloses a two-piece pre-mold that holds a plurality of blade-type receptacle contacts that have distally located wire crimping ends. The Shulman et al. '751 patent also discloses a two-piece pre-mold, but instead holds a plurality of clothespin-type receptacle contacts.

Brown et al. U.S. Pat. Nos. 5,443,400 and 5,888,105, which are also owned by the assignee of the present application, relate to a molded powercord with multiple female outlet sites. Each of these patents also discloses electrical contact stampings, each of which has multiple female blade-type contacts and a wire crimping end. Furthermore, each female contact is sized, shaped and positioned so as to provide one contact for a corresponding one of the multiple outlet sites. The patents do not, however, disclose a housing or casing which is provided with an internal structure adapted to receive contact stampings. Rather, the stampings of these patents are held in their preferred spatial relationship by a spacer element and overmolding.

Doudon U.S. Pat. No. 5,582,520 and Lax U.S. Pat. No. 4,717,350 both relate to electrical outlet units that include rigid two-piece housings, rather than pre-molds, with multiple female outlet sites on one exterior wall thereof. Each outlet site comprises three openings in the exterior wall that are each sized and shaped so as to receive a male blade of an electrical plug. The Lax '350 patent utilizes wires, rather than stampings, to provide the electrical contacts for each outlet. The Doudon '520 patent discloses a housing with exterior and interior walls where the interior walls define cavities and recesses that are sized and shaped so as to receive electrical contacts therein.

Blanche U.S. Pat. 5,816,860 discloses a female outlet adapter with multiple outlet sites and stampings with multiple blade-type female receptacles. The adapter does not, however, include a pre-mold.

Lee U.S. Pat. No. 4,979,907 also relates to an electrical unit with multiple female outlets. The electrical unit disclosed in the Lee '907 patent does not, however, include a pre-mold.

It is therefore an object of the present invention to provide a multi-receptacle outlet incorporating a premold that securely holds a plurality of contacts that is suitable for overmolding to yield a composite multi-receptacle female outlet.

SUMMARY OF THE INVENTION

The problems and disadvantages associated with the conventional techniques and devices utilized as electrical outlets are overcome by the present invention which includes a premold for a powercord that has multiple female electrical outlet sites. In one embodiment, the premold includes a housing which is provided with a network of walls and partitions that form channels and cavities adapted to securely receive a plurality of busbar stampings, each with multiple female contacts. In addition, an external front wall of the housing is provided with three outlet sites, each of which has three openings (i.e., ground, positive and negative openings) that are shaped and sized to receive corresponding male contacts of an electrical plug. More particularly, each busbar stamping has a crossbar, three female contacts and a wire crimp extension. The wire crimp extension of each stamping extends from the back of the crossbar and connects by crimping to a corresponding wire of a power supply cable.

In a preferred embodiment, there are three busbar stampings: a ground stamping; a positive stamping; and a negative stamping. The ground stamping has three female ground contacts that are each sized and shaped so as to receive a corresponding ground pin on a male plug and that extend from the front of the crossbar such that they each align with the ground opening of a corresponding outlet site. The positive stamping has three positive blade-type female contacts that are each sized and shaped so as to receive a corresponding positive male blade on a male plug and that extend from the front of the crossbar such that they each align with the positive opening of each corresponding outlet site. Similarly, the negative stamping has three negative blade-type female contacts that are each sized and shaped so as to receive a corresponding negative male blade on a male plug and that extend from the front of the crossbar such that they each align with the negative opening of each corresponding outlet site. The three stampings are securely received within the cavities and channels of the housing in a stacked array. Thus, the crossbars are arranged in a parallel orientation one above the other.

In the preferred embodiment, a cap is sized and shaped such that it can be snapped securely onto the back of the housing. The cap includes three openings that are sized and shaped to receive the wire crimp extensions of the stampings. Thus, once the cap is secured to the housing, the stampings are snugly retained within the cavities and channels of the housing. In addition, the wire crimp extensions protrude from the back of the assembled premold in a staggered relationship relative to one another.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
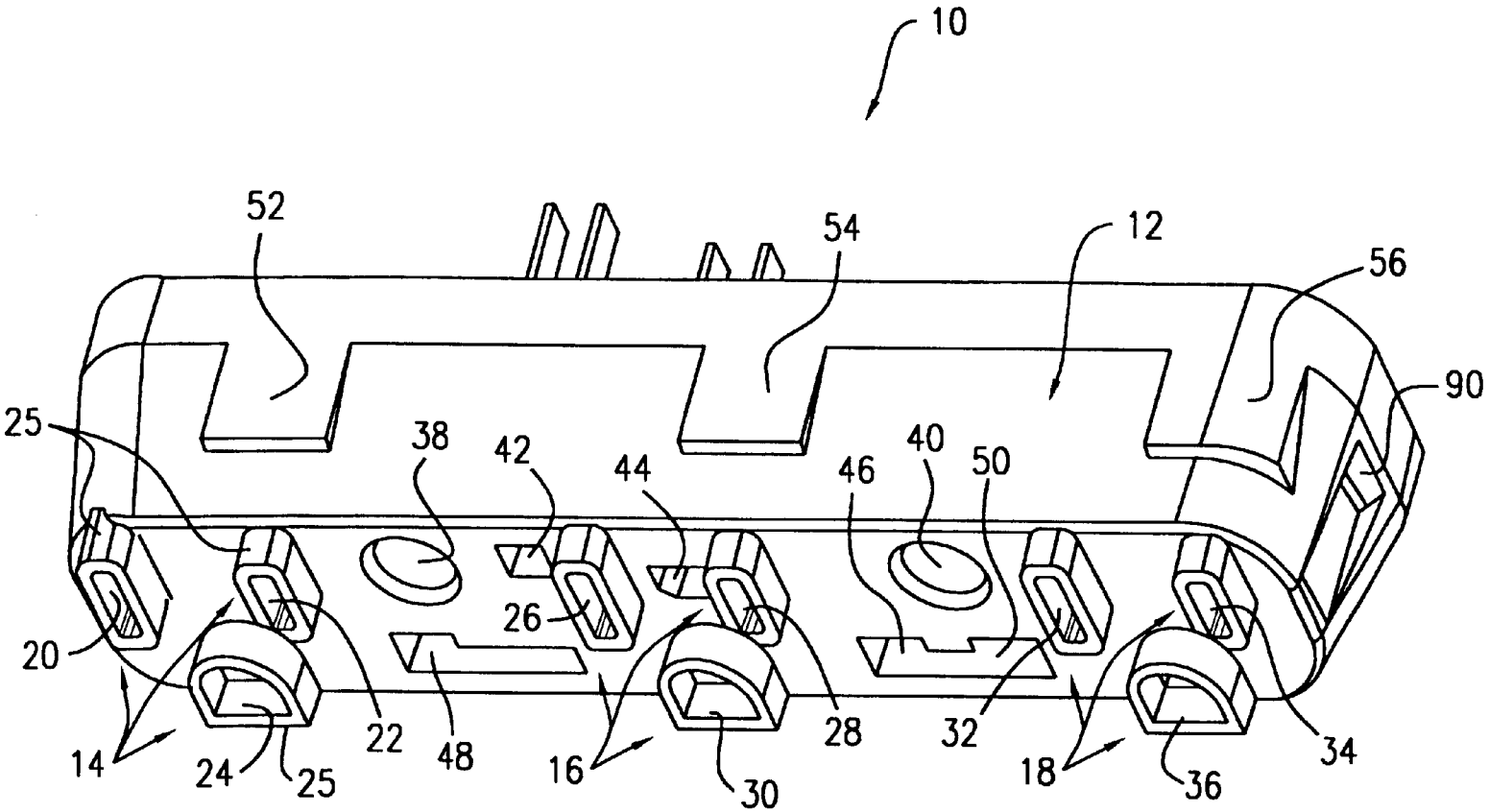
FIG. 1 is a front perspective view of a premold assembly in accordance with an exemplary embodiment of the present invention.

FIG. 1 shows a premold assembly 10 in accordance with an embodiment of the present invention and having a housing 12 with a plurality of female outlet groupings 14, 16, 18. The outlet groupings shown each have a large blade opening 20, 26, 32, a small blade opening 22,28,34 and a ground blade opening 24, 30, 26, respectively. Each of the blade openings, e.g., 20,22,24 has a peripheral prominence 25. In the embodiment shown, the female outlet groupings 14, 16, 18 have the standard configuration of a polarized 120 volt outlet as would be encountered in the United States. It will be apparent, however, that the present invention would be suitable for forming other outlet configurations, such as those used in the United States for higher voltages and for outlet configurations used abroad. The housing 12 incorporates a pair of overmolding inflow cavities 38, 40 to receive flowable overmolding compound therein to more fully integrate the overmolding material to the premold assembly 12. While two cavities 38,40 are shown, a greater or lesser number could be employed. Molding pin cavities 42, 44, 46 are used for forming support surfaces 164, 166, 168 (see FIG. 7) proximate the rear of the housing 12 and also function as overmolding inflow cavities. The housing 12 also includes a pair of male catch molding cavities 48, 50 for forming male catches 84, 86 (see FIG. 2) extending from the rear of the housing. The housing 12 incorporates a plurality of peripheral reinforcement blocks 52, 54, 56 that act to stiffen and strengthen the housing proximate to contact cavities 140, 142, 144 (see FIG. 7) near the exterior wall of the housing 12. Female catch cavities 58, 60 (see FIG. 7 for 58) are formed on opposite sides of the housing 12 to facilitate assembling a rear cover plate 62 (see FIG. 2) to the housing 12.

Figure 2:
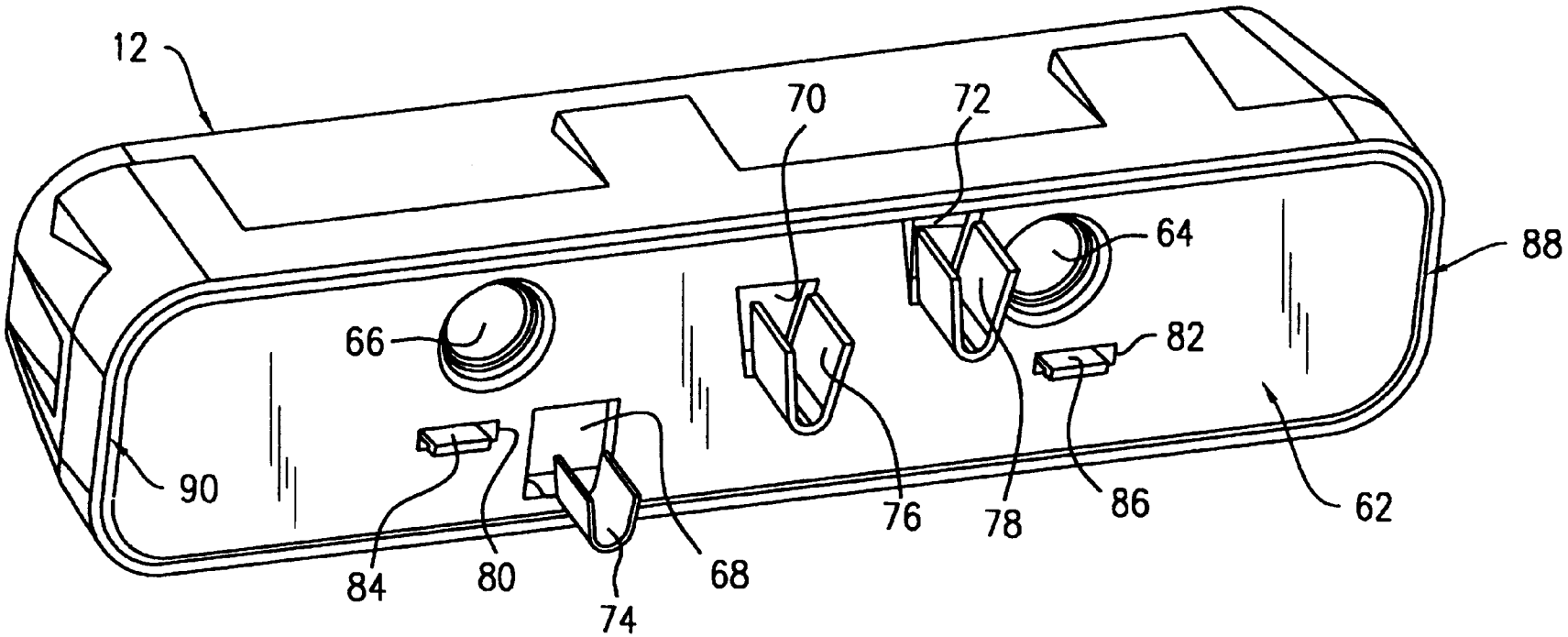
FIG. 2 is a rear perspective view of the premold assembly of FIG. 1.

FIG. 2 shows the rear cover plate 62 assembled to the rear of the housing 12 wherein the rear cover plate 62 has an outer peripheral shape that mates with the rear side of the housing 12. In the embodiment shown, the rear cover plate 62 is slightly smaller than that the outer peripheral extent of the housing 12, such that the rear cover plate 62 inserts within a peripheral lip of the outer peripheral wall of the housing 12. The rear cover plate 62 has top overmolding inflow openings 64, 66 that align and communicate with the inflow cavities 38, 40, respectively, in the housing. Three openings 68, 70, 72 in the rear cover plate 62 allow crimp terminals 74, 76, 78, respectively, to extend therethrough. Catch openings 80, 82 accommodate male catch members 84, 86, respectively, which extend therethrough and clip over the edge of a corresponding catch opening to retain the rear cover plate 62 in removable association with the housing 12. To further secure the rear cover plate 62, male catches 88, 90 (see FIGS. 3 and 8) extend from either side of the rear cover plate 62 and extend into mating female catch cavities 58, 60, respectively, (see FIGS. 3 and 7) provided in the housing 12.

Figure 3:
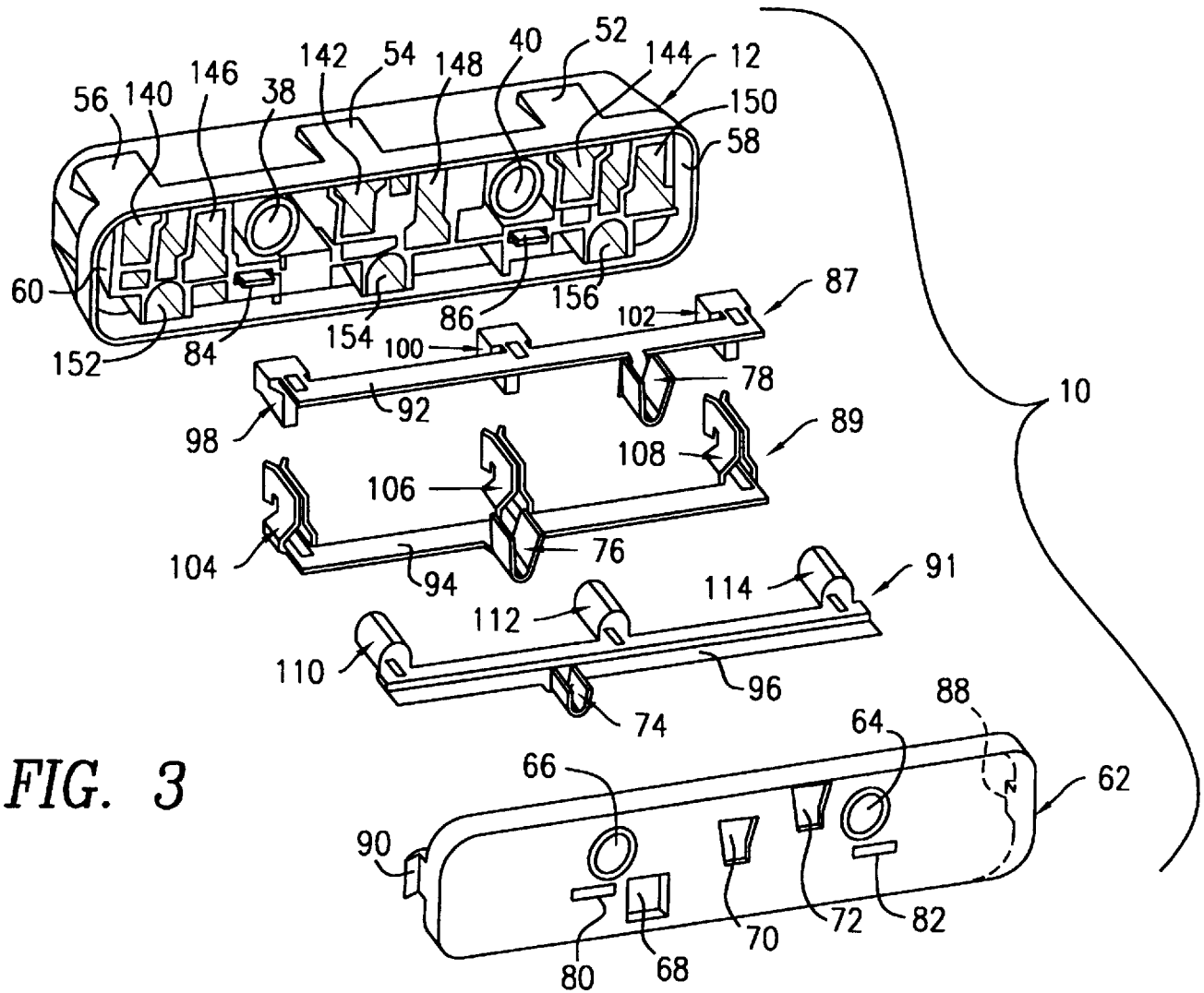
FIG. 3 is an exploded perspective view of the premold assembly of FIGS. 1 and 2.

FIG. 3 shows the interior of the housing 12, which has a honeycomb-like configuration with a plurality of divider walls forming a number of mutually insulated cells/slots used for containing the terminal groups 87, 89, 91 in relative electrical insulation. Each terminal group 87, 89, 91 has a set of contact terminals 98, 100, 102; 104, 106, 108; and 110, 112, 114, respectively, extending from a bus bar 92, 94, 96, respectively. The terminal groups 87, 89, 91 and how they fit into the housing 12 shall be described more fully below in reference to FIGS. 4–7.

Figure 4:
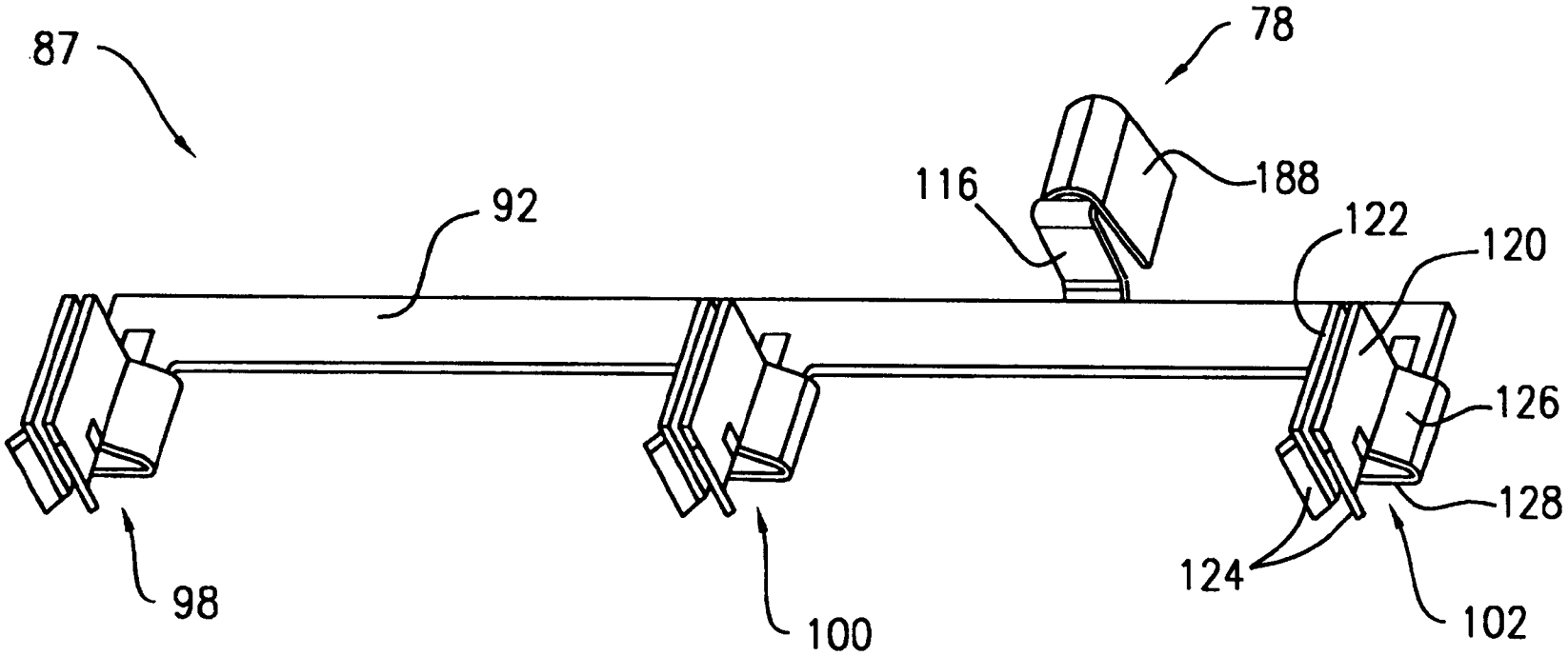
FIG. 4 is an enlarged perspective view of a first electrical terminal group used in the premold assembly of FIGS. 1–3, the terminal group having been rotated, from the position shown in FIG. 3, 180° about a longitudinal axis thereof.

FIG. 4 shows that terminal group 87 has a crimp terminal 78 having a pair of crimp ears 118 attached to bus bar 92 via a positioning tab 116. The positioning tab 116 causes the crimp terminal 78 to extend toward the longitudinal centerline bisecting the rear cover plate 62 when the terminal group 87 is inserted into the housing in the position shown in FIG. 3. Each of the contact terminals 98, 100, 102 has a pair of opposed contact blades 120,122, each having an associated guide flange 124 and extending from a corresponding resilient arm 126 which is attached to a base member 128 extending from the bus bar 92. As can be appreciated, the contact terminals 98, 100, 102 are adapted to interact with substantially flat male plug blades which are inserted between the opposing contact blades 120,122.

Figure 5:
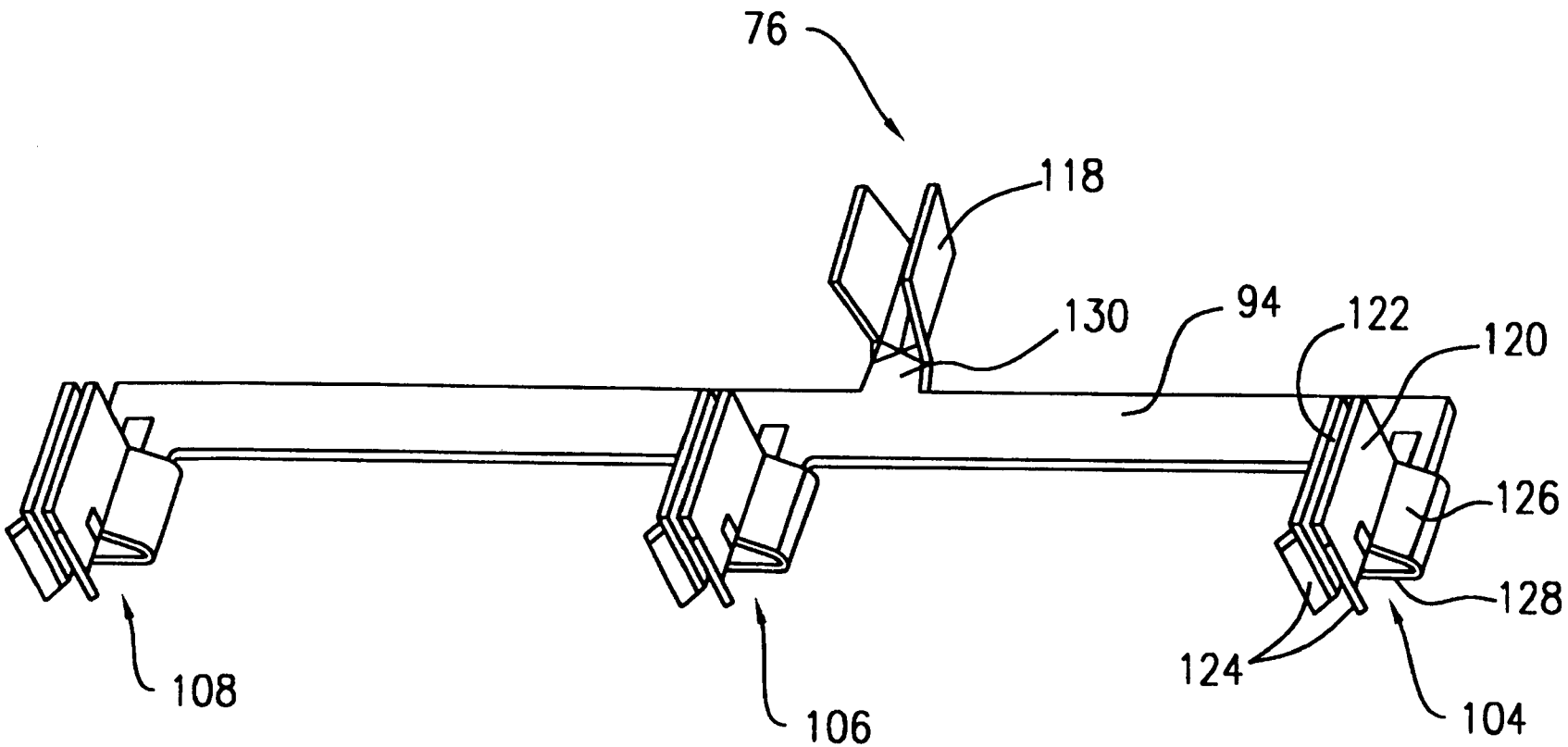
FIG. 5 is an enlarged perspective view of a second electrical terminal group used in the premold assembly of FIGS. 1–3, the terminal group having been rotated, from the position shown in FIG. 3, 180° about an axis normal to a longitudinal axis thereof.

FIG. 5 shows that terminal group 89 has a similar construct to terminal group 87, except that the crimp terminal 76 has a straight positioning tab 130. More specifically, each of the contact terminals 104, 106, 108 has a pair of opposed contact blades 120,122, each having an associated guide flange 124 and extending from a corresponding resilient arm 126 which is attached to a base member 128 extending from the bus bar 94. As can be appreciated, the contact terminals 104, 106, 108 are adapted to interact with substantially flat male plug blades which are inserted between the opposing contact blades 120, 122.

Figure 6:
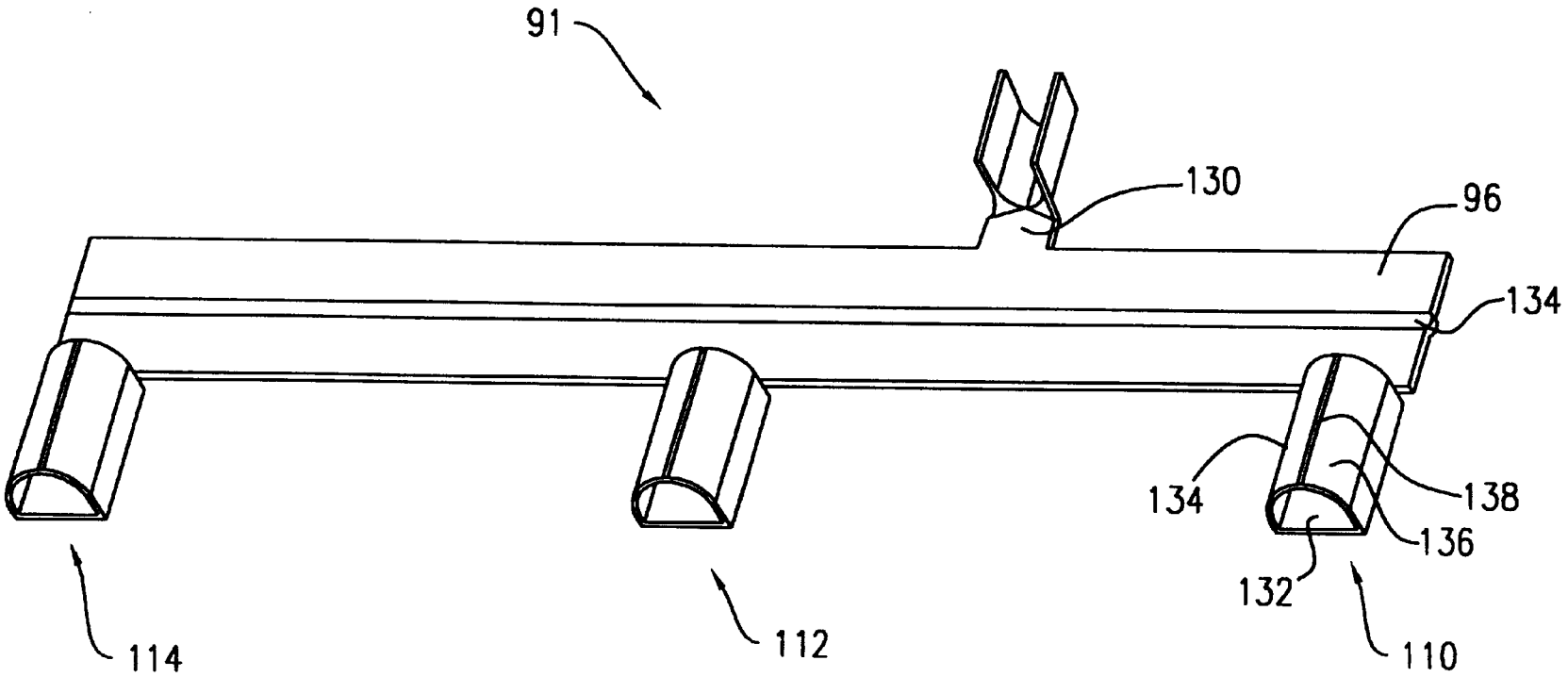
FIG. 6 is an enlarged perspective view of a third electrical terminal group used in the premold assembly of FIGS. 1–3, the terminal group having been rotated, from the position shown in FIG. 3, 180° about an axis normal to a longitudinal axis thereof.

FIG. 6 shows terminal group 91 having a plurality of contact terminals 110, 112, 114 each having a pair of arcuate side panels 134, 136 extending from base panel 132 and which terminate at split 138. The bus bar 96 has a crease extending along its length which increases the rigidity of the bus bar 96 and effectively increases the thickness of the bus bar 96 such that its frictional interaction with the housing 12 is increased. As can be appreciated, the contact terminals 110, 112, 114 are adapted to receive a substantially cylindrical ground pin of a male plug.

Figure 7:
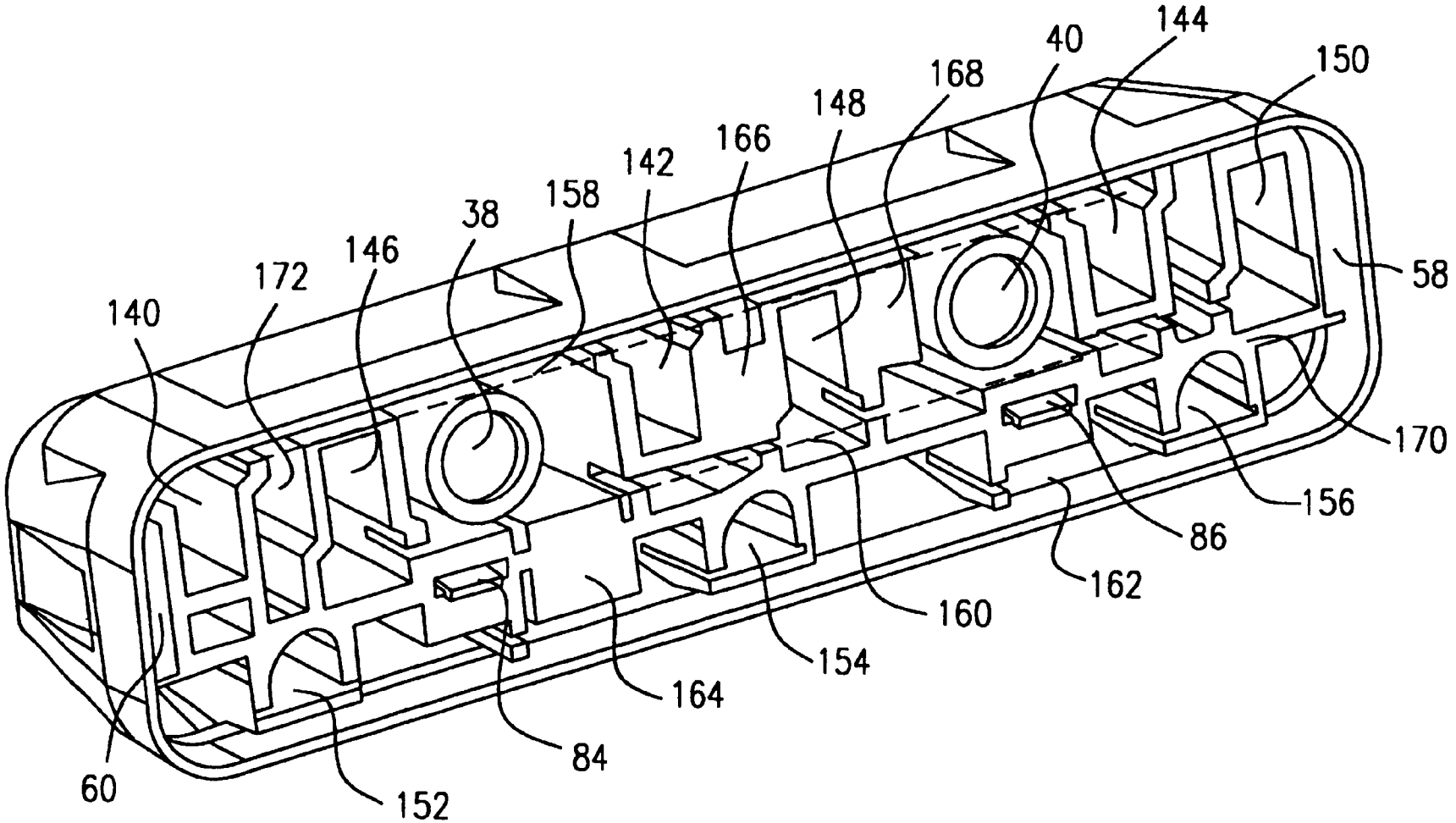
FIG. 7 is an enlarged, rear perspective view of the housing of the premold assembly of FIGS. 1–3.

FIG. 7 shows that the housing 12 has a first set of cells 140, 142, 144 for accommodating the contact terminals 98,100,102 of terminal group 87. The bus bar 92 of terminal group 87 is accommodated in a longitudinal slot provided in housing 12 proximate to dashed line 158. A second set of cells 146, 148, 150 accommodate the terminal contacts 104, 106, 108 of terminal group 89, with the bus bar 94 being accommodated in a slot in the housing 12 proximate to dashed line 160. Contact terminals 110, 112, 114 of terminal group 91 are accommodated in a third set of cells 152, 154, 156 which have a complementary shape to that of the terminals 110, 112, 114. Busbar 96 is received in a slot indicated at dashed line 162. Three support surfaces 164, 166, 168 are provided to provide backing support for crimps 74, 76, 78. As shown in FIG. 7, the housing 12 has a plurality of internal walls 170 that divide the space contained within the housing into a plurality of electrically separate cells, e.g., 140, 146, 152. There are spacing cells 172 between the cells containing terminal contacts in order to hold the terminal contacts in the correct relative position, to increase the strength of the premold assembly 10 and to maintain electrical discontinuity between contact groups with different polarity.

Figure 8:
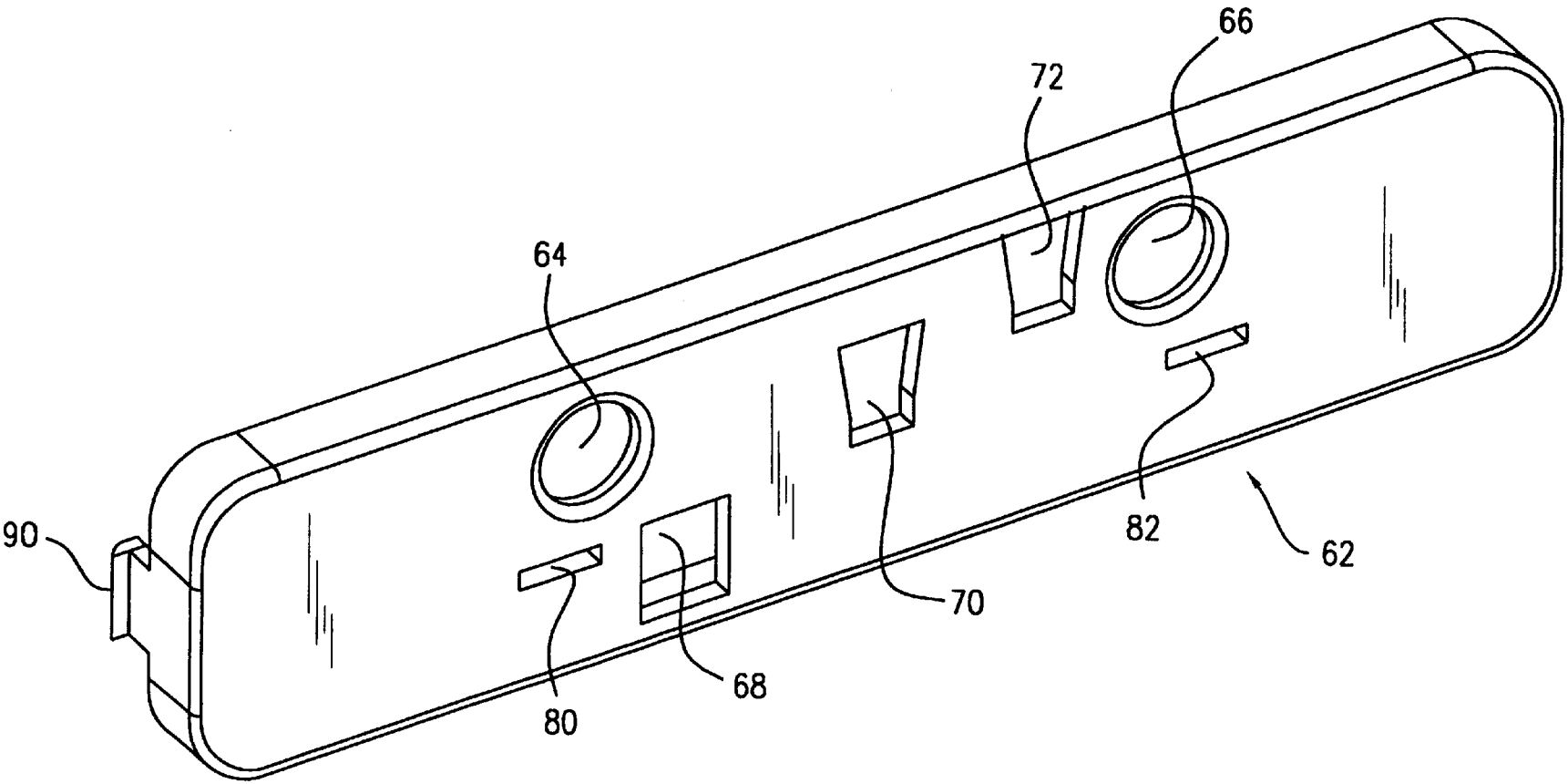
FIG. 8 is an enlarged, front perspective view of a rear cover plate of the premold assembly of FIGS. 1–3.

FIG. 8 shows the rear cover plate 62 with the male catch 90, which inserts into and grips the female catch cavity 60. The other male catch 88 (see FIG. 3) is not shown in FIG. 8, but it is similar to the male catch 90 and cooperates with the female catch cavity 58 in the same manner that the male catch 90 cooperates with the female catch cavity 60.

Having described the various parts and structural relationships of a premold assembly in accordance with the present invention, it can be appreciated that the present invention can be used by inserting the terminal groups 87, 89, 91 into the housing 12 such that the respective bus bars 92, 94, 96 are received in the slots proximate dashed lines 158, 160, 162. In such position, the terminal contacts (e.g., 98, 100, 102) are positioned in their associated cells (e.g., 140, 142, 144) of the housing 12. After all of the terminal groups 87, 89, 91 have been installed within the housing 12, the rear cover plate 62 can be snapped in place over the rear of the housing 12 to retain the terminal groups therein in electrical isolation relative to one another. The crimp terminals 74, 76, 78 can then be crimped to a wire set and the wire and premold assembly overmolded to form an insulated, composite electrical outlet having a plurality of female outlet groups to receive a corresponding plurality of male plugs therein. As shown in FIG. 2, the angled positioning tab 116 of the terminal group 87 functions in conjunction with the straight positioning tabs 130 of the terminal groups 89, 91 to result in the crimp terminals 74, 76, 78 being positioned in ascending relative elevations when assembled in the premold assembly 10.

It should be understood that the embodiment described herein is merely exemplary and that a person skilled in the art may make many variations and modifications without departing from the spirit and scope of the invention. For instance, the premold can be adapted to receive only a pair of busbar stampings (i.e., a positive stamping and a negative stamping). Accordingly, all such variations and modifications are intended to be included within the scope of the invention.

We claim:

1. A premold for a powercord, comprising a housing which includes first receiving means, formed in a rear wall of said housing and extending into said housing toward a front wall thereof, for receiving a positive stamping having a positive crossbar and a plurality of positive blade-type female contacts extending from a front edge of said positive crossbar toward said front wall of said housing, each of said positive contacts being sized and shaped so as to receive a corresponding male blade of a male electrical plug, said positive stamping further including a first wire crimp extension extending beyond said rear wall of said housing from a rear edge of said positive crossbar, second receiving means, formed in said rear wall of said housing and extending into said housing toward said front wall thereof, for receiving a negative stamping having a negative crossbar and a plurality of negative blade-type female contacts extending from a front edge of said negative crossbar toward said front wall of said housing, each of said negative contacts being sized and shaped so as to receive a corresponding negative male blade of a male electrical plug, said negative stamping further including a second wire crimp extension extending beyond said rear wall of said housing from a rear edge of said negative crossbar, third receiving means, formed in said rear wall of said housing and extending into said housing toward said front wall thereof, for receiving a ground stamping having a ground crossbar and a plurality of female ground contacts extending from a front edge of said ground crossbar toward said front wall of said housing, each of said ground contacts being sized and shaped so as to receive a corresponding ground pin of a grounded male electrical plug, said ground stamping further including a third wire crimp extension extending beyond said rear wall of said housing from a rear edge of said ground crossbar, said front wall of said housing having a plurality of female electrical outlet sites, each of which includes a corresponding one of the female contacts of said positive stamping, a corresponding one of the female contacts of said negative stamping, and a corresponding one of the female contacts of said ground stamping, said first, second, and third receiving means being defined by a network of walls and partitions which cooperate to form internal chambers and cavities within said housing; and a cap attached to said rear wall of said housing, said cap including a first opening sized and shaped so as to allow said first wire crimp extension to protrude therethrough, a second opening sized and shaped so as to allow said second wire crimp extension to protrude therethrough, and a third opening sized and shaped so as to allow said third wire crimp extension to protrude therethrough.

2. A premold according to claim 1, wherein said cap retains said ground stamping, said positive stamping and said negative stamping within said cavities and channels of said housing.

3. A premold according to claim 2, wherein said ground stamping, said positive stamping and said negative stamping are arranged in a stacked array within said housing.

4. A premold according to claim 3, wherein said ground crossbar, said positive crossbar and said negative crossbar are arranged in a parallel orientation one above the other.

5. A premold according to claim 4, wherein said first opening, said second opening and said third opening of said cap are arranged in a staggered relationship relative to one another.

6. A premold according to claim 5, wherein said positive stamping includes three of said positive blade-type female contacts, said negative stamping includes three of said negative blade-type female contacts, and said ground stamping includes three of said female ground contacts.

7. A premold according to claim 1, wherein said network of walls and partitions electrically insulates said female contacts from each other.

8. A premold according to claim 1, wherein said female contacts of said positive stamping are positioned in one direction and said female contacts of said negative stamping are positioned in an opposite direction relative to said one direction such that said female contacts of said positive stamping and said female contacts of said negative stamping are linearly arranged relative to one another, when said positive stamping is received in said first receiving means and said negative stamping is received in said second receiving means.

9. A premold according to claim 1, wherein said cap is snapped to said rear wall of said housing.

10. A premold according to claim 9, wherein said housing includes a first and second female catch cavity and said cap includes a first male catch sized and shaped to be received within said first female catch cavity and a second male catch sized and shaped to be received within said second female catch cavity.

* * * * *